US007788865B2

(12) United States Patent
Koenig, Jr. et al.

(10) Patent No.: US 7,788,865 B2
(45) Date of Patent: Sep. 7, 2010

(54) DRYWALL TRIMMING ELEMENT WITH COMPOUND LOCKING FEATURE

(75) Inventors: Joseph M. Koenig, Jr., Glenview, IL (US); Mark Budzik, Des Plaines, IL (US)

(73) Assignee: Trim-Tex, Inc., Lincolnwood, IL (US)

( * ) Notice: Subject to any disclaimer, the term of this patent is extended or adjusted under 35 U.S.C. 154(b) by 75 days.

(21) Appl. No.: 12/032,843

(22) Filed: Feb. 18, 2008

(65) Prior Publication Data

US 2009/0205279 A1 Aug. 20, 2009

(51) Int. Cl.
*E04B 1/00* (2006.01)

(52) U.S. Cl. ..... 52/255; 52/256; 52/257; 52/417

(58) Field of Classification Search ..... 52/254–257, 52/287.1, DIG. 6, DIG. 13, 443; D25/123, D25/125
See application file for complete search history.

(56) References Cited

U.S. PATENT DOCUMENTS

| | | | | | |
|---|---|---|---|---|---|
| 290,750 | A | * | 12/1883 | Da Cunha | 52/255 |
| 308,312 | A | * | 11/1884 | Gardner | 52/716.1 |
| 658,386 | A | * | 9/1900 | Mitchell | 52/257 |
| 1,185,231 | A | * | 5/1916 | Miller | 217/70 |
| 1,308,773 | A | * | 7/1919 | Clark | 52/255 |
| 1,470,835 | A | * | 10/1923 | Hathaway | 249/176 |
| 1,594,756 | A | * | 8/1926 | Richards | 52/255 |
| 1,804,564 | A | * | 5/1931 | McChesney | 52/255 |
| 2,005,572 | A | * | 6/1935 | Vass | 52/85 |
| 2,012,203 | A | * | 8/1935 | Peterson | 52/255 |
| 2,111,922 | A | * | 3/1938 | Borkenstein | 52/716.1 |
| 2,344,279 | A | * | 3/1944 | Beerthuis | 52/99 |
| 2,573,482 | A | * | 10/1951 | Peik | 52/443 |
| 3,011,226 | A | * | 12/1961 | Menge | 411/466 |
| 3,266,362 | A | * | 8/1966 | Ray | 411/466 |

(Continued)

FOREIGN PATENT DOCUMENTS

EP 134039 A2 * 3/1985

(Continued)

OTHER PUBLICATIONS

Trim-Tex Catalog from website address www.trim-tex.com/catalog/catalogindex.html.

(Continued)

*Primary Examiner*—Richard E Chilcot, Jr.
*Assistant Examiner*—Alp Akbasli
(74) *Attorney, Agent, or Firm*—Levenfeld Pearlstein, LLC

(57) ABSTRACT

A drywall trimming element for bridging two sections of drywall is an extruded element having first and second opposing flanges each having an interior surface and an exterior surface. The element is secured to the drywall by joint compound. The interior surfaces are adapted to be positioned on or adjacent to a respective one of the drywall surfaces. The interior and exterior surfaces each define respective surface planes. One or both of the interior and exterior surfaces have a plurality of upstanding longitudinally oriented ribs extending outwardly from the surface. The ribs extend away from their respective surfaces and define a void space between the surface adjacent to the ribs and an end of the ribs, such that a line extending outwardly from and normal to the surface of the flange adjacent to the ribs traverses through the void space and then subsequently contacts the ribs. The void space serves to provide a joint compound locking feature for the trimming element.

14 Claims, 4 Drawing Sheets

U.S. PATENT DOCUMENTS

| | | | | | |
|---|---|---|---|---|---|
| 3,305,252 | A | * | 2/1967 | Jureit | 403/170 |
| 3,398,494 | A | * | 8/1968 | Larson | 52/371 |
| 3,498,171 | A | * | 3/1970 | Jureit | 411/466 |
| T887,014 | I4 | * | 6/1971 | Overbay et al. | 428/211.1 |
| D227,983 | S | * | 7/1973 | La Borde | D25/125 |
| D228,180 | S | * | 8/1973 | La Borde | D25/125 |
| 3,863,412 | A | * | 2/1975 | Bodycomb et al. | 52/481.2 |
| RE28,427 | E | * | 5/1975 | Menge | 411/466 |
| 4,209,043 | A | * | 6/1980 | Menzel | 138/154 |
| 4,443,508 | A | * | 4/1984 | Mehl | 428/122 |
| 4,863,774 | A | * | 9/1989 | Tucker | 428/77 |
| 4,876,837 | A | * | 10/1989 | Kelly et al. | 52/287.1 |
| 4,879,854 | A | * | 11/1989 | Handler | 52/238.1 |
| 4,999,233 | A | * | 3/1991 | Probst et al. | 428/122 |
| 5,045,374 | A | * | 9/1991 | Tucker | 428/83 |
| 5,086,598 | A | | 2/1992 | Weldy | |
| 5,138,810 | A | * | 8/1992 | Kartler | 52/254 |
| 5,157,886 | A | * | 10/1992 | Azzar et al. | 52/717.05 |
| 5,193,322 | A | * | 3/1993 | Wood | 52/718.01 |
| 5,203,640 | A | * | 4/1993 | Pourtau et al. | 403/403 |
| RE34,547 | E | | 2/1994 | Weldy | |
| 5,313,755 | A | | 5/1994 | Koenig, Jr. | |
| 5,368,907 | A | * | 11/1994 | Conboy | 428/43 |
| 5,410,854 | A | * | 5/1995 | Kimmell et al. | 52/712 |
| 5,442,886 | A | * | 8/1995 | Iacobelli | 52/255 |
| 5,611,181 | A | * | 3/1997 | Shreiner et al. | 52/396.04 |
| 5,625,986 | A | * | 5/1997 | Mansfield et al. | 52/255 |
| 5,662,753 | A | * | 9/1997 | Loos | 156/71 |
| 5,699,638 | A | * | 12/1997 | Maylon | 52/86 |
| 5,752,353 | A | * | 5/1998 | Koenig et al. | 52/255 |
| 5,778,617 | A | * | 7/1998 | Free | 52/255 |
| D398,708 | S | * | 9/1998 | Opielski et al. | D25/119 |
| 5,816,002 | A | * | 10/1998 | Bifano et al. | 52/255 |
| 5,904,016 | A | * | 5/1999 | Koenig et al. | 52/255 |
| 5,943,835 | A | * | 8/1999 | von Saint-George | 52/287.1 |
| 5,974,746 | A | * | 11/1999 | Mathias | 52/255 |
| 6,009,678 | A | * | 1/2000 | Franco da Encarnaçao | 52/327 |
| 6,070,374 | A | * | 6/2000 | Bifano et al. | 52/86 |
| 6,119,420 | A | | 9/2000 | Koenig, Jr. et al. | |
| 6,145,259 | A | * | 11/2000 | Koenig et al. | 52/287.1 |
| 6,212,836 | B1 | * | 4/2001 | Larson | 52/287.1 |
| 6,427,418 | B1 | * | 8/2002 | Zell | 52/745.05 |
| 6,447,872 | B1 | * | 9/2002 | Larson | 428/77 |
| 6,543,194 | B2 | * | 4/2003 | Harel | 52/287.1 |
| 6,571,520 | B2 | | 6/2003 | Koenig, Jr. et al. | |
| 6,655,103 | B1 | * | 12/2003 | Lueghamer | 52/598 |
| 6,691,476 | B1 | * | 2/2004 | Kunz | 52/287.1 |
| 6,691,477 | B2 | | 2/2004 | Koenig, Jr. et al. | |
| D487,520 | S | * | 3/2004 | Hein et al. | D25/102 |
| 6,901,707 | B2 | * | 6/2005 | Smerud | 52/85 |
| 7,021,879 | B2 | * | 4/2006 | Taneichi | 411/466 |
| 7,137,231 | B2 | | 11/2006 | Harel | |
| 7,165,373 | B2 | * | 1/2007 | Smythe, Jr. | 52/746.1 |
| 7,200,970 | B2 | | 4/2007 | Koenig, Jr. et al. | |
| 7,673,428 | B1 | * | 3/2010 | Smythe | 52/255 |
| 2002/0005023 | A1 | * | 1/2002 | Ford | 52/514 |
| 2004/0093816 | A1 | * | 5/2004 | Smythe, Jr. | 52/255 |
| 2004/0163340 | A1 | * | 8/2004 | Harel | 52/287.1 |
| 2006/0059809 | A1 | | 3/2006 | Smythe, Jr. | |
| 2006/0150570 | A1 | | 7/2006 | Fitzpatrick et al. | |
| 2007/0000196 | A1 | * | 1/2007 | Depaul | 52/287.1 |
| 2008/0066403 | A1 | * | 3/2008 | Koenig et al. | 52/255 |
| 2008/0172963 | A1 | * | 7/2008 | Harrison | 52/287.1 |
| 2009/0145059 | A1 | * | 6/2009 | Kay | 52/179 |

FOREIGN PATENT DOCUMENTS

| | | | | |
|---|---|---|---|---|
| EP | 638697 | A1 | * | 2/1995 |
| EP | 638698 | A1 | * | 2/1995 |
| GB | 2056523 | A | * | 3/1981 |
| GB | 2234284 | A | * | 1/1991 |

OTHER PUBLICATIONS

Walls & Ceilings, Jun. 2007, Manufacturer's Spotlight Issue.

* cited by examiner

DRYWALL TRIMMING ELEMENT WITH COMPOUND LOCKING FEATURE

BACKGROUND OF THE INVENTION

The present invention is directed to a drywall trimming element. More particularly, the present invention pertains to a drywall trimming element having a compound locking feature to enhance the bond between the element and the compound.

Drywall trimming elements are used at the intersection of drywall planes. For example, a drywall trimming element can be used at the intersection of two planes that define an outer corner. The trimming elements protect the edges and corners of the drywall from bumps, abrasions and damage. Trimming elements can also be used at inside corners (intersections that define an acute angle), to provide a smooth and visually appealing finish, as well as to protect the inside corner from damage.

Outside trimming elements are presently made, in one form, from metal. The metal corner bead includes an elongate corner, typically rolled or bent, and a pair of flanges or legs extending from the corner at about a 90 degree angle. To set these metal corner beads in place, the bead is fastened to the support behind the wall board (such as a wood stud) by screws, nails or the like through the legs. One or more layers of joint compound are applied over the bead, from the corner outwardly, over the legs, and smoothed to the wall surface (referred to as feathering), to eliminate any visual distinction from the corner to the wall surface.

While metal corner beads do in fact protect the drywall corners from damage, they too can be subject to damage, for example, when bumped or struck. In addition, the adhesion or bonding of the compound to the metal bead is limited. As such, with even a minor strike of the bead, the compound can separate from the bead resulting in a crack, crevasse or open spot at the corner bead.

Extruded plastic moldings have come into greater use (over metal) for a number of reasons. First, is their ease of use—they are easy to install, cut (when necessary) and fit to a corner. They are also much more "forgiving" and less subject to unwanted bending than metal when being stored and handled. Moreover, extruded materials will not discolor (e.g., rust) or corrode when subject to less than ideal or controlled environmental conditions.

It has also been found that extruded materials (moldings) can be formed into a wide variety of shapes and sizes. As such, extruded materials are used to form large radius corner elements, such as that disclosed in Koenig, Jr., et al., U.S. Pat. No. 6,691,477, crown moldings and crown-type moldings, as disclosed in Koenig, Jr., et al., U.S. Pat. No. 7,200,970, and archway moldings, as disclosed in Koenig, Jr., et al., U.S. Pat. No. 6,119,420, all of which are commonly assigned with the present application and all of which are incorporated herein by reference.

In order to secure the elements and moldings to the drywall, one or both of the legs of the elements and molding have openings therein. A fastener can be used to secure the element to the wall and one or more layers of joint compound are applied over the legs to create a smooth transition from the element to the wall surface. In some installations, the element is installed without the fastener, in which case a layer of joint compound is applied to the wall and the element is pressed into the wet joint compound. The openings in the element allow for the flow of joint compound therethrough which, when dried, hardens to secure the element to the wall.

Even though the hardened joint compound bonds well to and secures the element to the wall, it has been observed that when the element is struck a relatively hard blow, the compound will crack and the element can separate from the wall. While minor cracks can generally be readily fixed with sanding and applications of fresh compound (with intermediate sanding) and painting, if the element separates from the wall, repair is usually not so readily accomplished. That is, when the element separates from the wall, dried compound may fall from the wall or element and prevent the element from lying flush on the wall. This can result in the element bulging from the wall at locations where compound has collected between the element and the wall. It has also been observed that cracking and the like often occurs during settling of a wall/structure.

It has also been found that with substantial blows to the element, exterior compound can separate from the element. While this is readily repaired, the more cracking or chipping that occurs, the more repair that it required.

Accordingly, there is a need for a drywall trimming element that secures to a drywall with a high degree of integrity. Desirably, such an element permits being readily secured to the wall with compound such that the compound will not loosen from the element when struck. More desirably, such an element includes provisions to "lock" the compound to the element in such a manner as to withstand a substantial blow.

BRIEF SUMMARY OF THE INVENTION

A drywall trimming element is used for bridging two sections of drywall and is configured for securing to the drywall by joint compound. The element includes first and second opposing flanges each having an interior surface and an exterior surface. The interior surfaces are adapted to be positioned on or adjacent to a respective one of the drywall surfaces and the exterior surfaces are adapted for orienting away from the drywall surfaces. The interior and exterior surfaces each define respective surface planes.

One or both of the interior and exterior surfaces have a plurality of upstanding longitudinally oriented ribs extending outwardly from the surface. The ribs extend away from their respective surfaces in a manner to define a void space between the surface adjacent to the ribs and an end of the ribs, such that a line extending outwardly from and normal to the surface of the flange adjacent to the ribs traverses through the void space and then subsequently contacts the ribs.

The void space is a region in which compound accumulates and sets around the rib, and from which the compound cannot be pulled directly away from the flange without contacting and moving the rib. The set joint compound is keyed into the void space and functions to lock the compound between the flange surface and the rib.

The ribs can be formed having a curved profile extending from the surface or a straight profile in which the ribs extend away from the flange at an angle other than 90 degrees to the surface of the flange. The ribs can also be formed having an enlarged head portion.

The ribs can be formed on the interior flange surfaces and/or the exterior flange surfaces, and can include openings or holes in one or both of the flanges.

The drywall trimming element can take the form of a corner element having a central curved or curvable portion between the flanges, a corner molding, an archway molding or any other drywall trimming element shape, configuration or functionality.

The trimming element can also be configured having one mounting flange having an interior surface adapted to be positioned on or adjacent to the drywall. The interior surface defines a surface plane and has a plurality of upstanding longitudinally oriented ribs extending outwardly from the surface. The ribs extends away from the surface to define a void space between the surface adjacent to the ribs and an end of the ribs, such that a line extending outwardly from and normal to the surface of the flange adjacent to the ribs traverses through the void space and then subsequently contacts the ribs.

Such an element can be configured to, for example, mount a chair rail or other architectural feature to dry wall.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
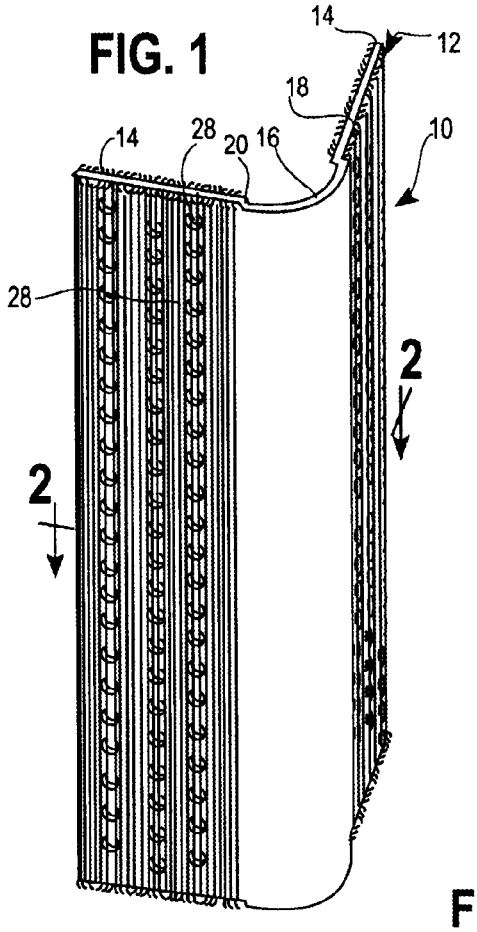
FIG. 1 is a perspective view of one type of corner element (a bull nose element) having a compound locking feature embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention", relates to a requirement of the United States Patent Office, and does not imply, nor should be inferred to limit the subject matter disclosed herein.

Referring now to the figures, and in particular to FIG. 1 there is shown an exemplary corner element 10 having a compound locking feature 12 embodying the principles of the present invention. The illustrated corner element 10 will be recognized by those skilled in the art as a bull nose corner element. The element 10 is so-named for its large radius rounded profile.

Figure 2:
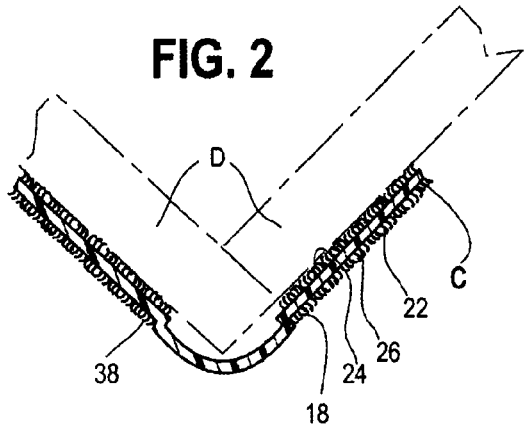
FIG. 2 is a cross-sectional view showing the corner element installed on a wall (outer) corner.

The element 10 has a pair of legs or flanges 14 extending outwardly from the radius portion 16. The flanges 14 are offset rearwardly (as indicated at 18) from the periphery of the radius portion 20 and define a "mud leg" for the element 10. As seen in FIG. 2, as indicated at 22, this is the region that accommodates joint compound C to secure the element 10 to the drywall D. The flanges 14 define an inner or interior surface 24, which is that surface that lies adjacent or facing the drywall D and an outer or exterior surface 26, which is that surface that is oriented outward from the wall D.

The flanges 14 can include openings 28 therein to accommodate fasteners (e.g., screws, nails or the like), if it is desired to use fasteners. The openings 28 can also accommodate joint compound that is applied (or flows) between the exterior 26 and interior 24 surfaces of the flange.

Figure 3:
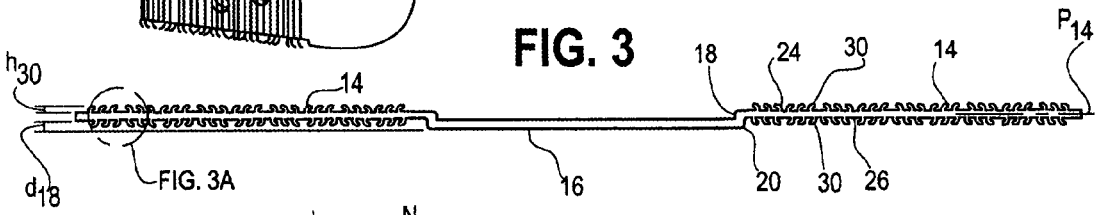
FIG. 3 is a sectional view or profile of the element of FIG. 1 shown in a flat form and FIG. 3A is an enlarged partial view of the element.
Figure 3A:
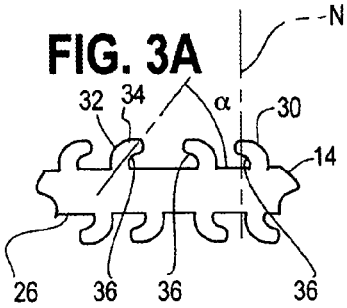

The flanges 14 include a novel compound locking feature 12 that provides regions around which the compound C hardens to bond the element 10 and compound to one another and to the drywall D. In one embodiment, as seen in FIGS. 3 and 3A, the flanges 14 include a plurality of ribs 30 that extend outwardly from the flange 14. The ribs 30 are formed longitudinally on the flange 14, traversing the length of the flange 14 (see FIG. 1 for the longitudinal orientation of the ribs 30).

The ribs 30 extend out from the flange 14 a distance (or height) $h_{30}$ that is less than the distance $d_{18}$ from the exterior surface 26 to the outer surface of the radius portion 16 (less than the offset 18). In this manner, the ribs 30 remain below a surface defined by the outermost peripheral profile of the radius portion 16 to provide a smooth transition of joint compound C to the drywall D surface.

The ribs 30 extend outwardly from the surface of the flange 14 at an acute angle $\alpha$ (as measured from the base 32 to an end 34 of the rib 30) relative to the plane $P_{14}$ of the flange 14. This creates a void space 36 between the surface of the flange 14 and the rib 30. The void space 36 is best seen by a line N extending from and normal to the flange 14 (or the plane $P_{14}$) that is spaced from the base 32 of the rib 30. The line N, as it extends upward traverses through the void space 36 and contacts the rib 30 at some point along the line N, along the rib 30. The void space 36 is a region in which compound C accumulates and sets (or hardens) around the rib 30, and from which the compound C cannot be pulled directly away from the flange 14 without contacting and moving the rib 30. Essentially, the set joint compound C is keyed into the void space 36 and functions to lock the compound C between the flange 14 and the rib 30.

Viewed another way, the set joint compound C forms a wedge of hardened material that is not readily pulled out from under the rib 30 nor from the joint compound that is set over the outward side of the rib (as indicated at 38). As seen in FIGS. 3 and 3A, the ribs 30 can be formed having a curved profile to create a larger void space 36 (compared to straight, angled ribs).

Figure 4A:
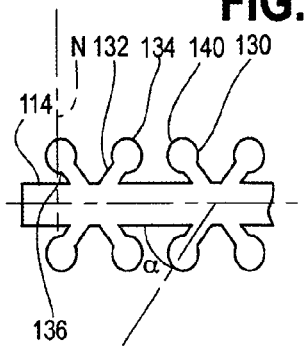
FIG. 4 is a sectional view or profile of an alternate embodiment of the element shown in a flat form and FIG. 4A is an enlarged partial view of the element.
Figure 4:
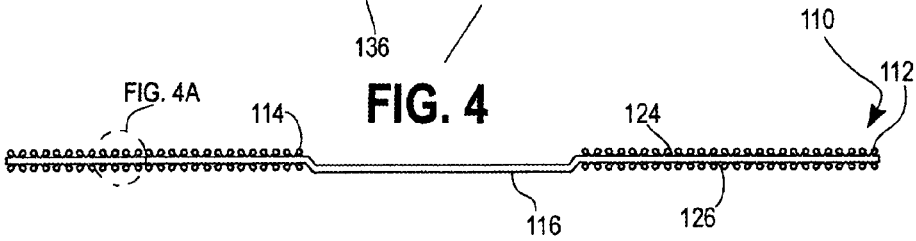

An alternate embodiment of the drywall element 110 having a compound locking feature 112 is illustrated in FIGS. 4 and 4A. In this embodiment, the ribs 130 are formed relatively straight from the base 132 to the end 134 of the rib 130, and with a bead 140 running longitudinally along the end 134 of the rib 130 (the bead 140 appears as a rounded shape in cross-section). The bead 140 creates a larger interference element in the set compound C, from which the rib 130 has to be pulled to dislodge the element 110.

Although both embodiments of the element 10, 110 are shown with ribs 30, 130 extending from both the inner 24, 124 and outer 26, 126 surfaces of the flange 14, 114, it will be appreciated that the elements 10, 110 could be formed with ribs 30, 130 extending from one or the other surface, as desired. It is also to be understood that the ribs 30, 130 on the outer surface 26, 126 bond to compound C that is applied to the outer surface 26, 126 or over the flange 14, 114. In this configuration, loosening of the compound C on the outer surface 26, 126 will be lessened when the element 10, 110 is struck.

Conversely, ribs 30, 130 on the inner surface 24, 124 will establish a better bond among the element 10, 110 and compound C and drywall D. In this manner, in the event that the element 10, 110 is struck, there is less tendency for the element 10, 110 to separate from the drywall D. This is extremely advantageous in that if the element 10, 110 does not separate from the drywall D and if only cracks along the sides of the element 10, 110 occur, then repair is minimal. On the other hand, if the element 10, 110 separates from the drywall D, then the element 10, 110 may have to be removed, the underlying drywall D repaired and the element 10, 110 (or a new element) installed, which is a much more involved repair.

Figure 5:
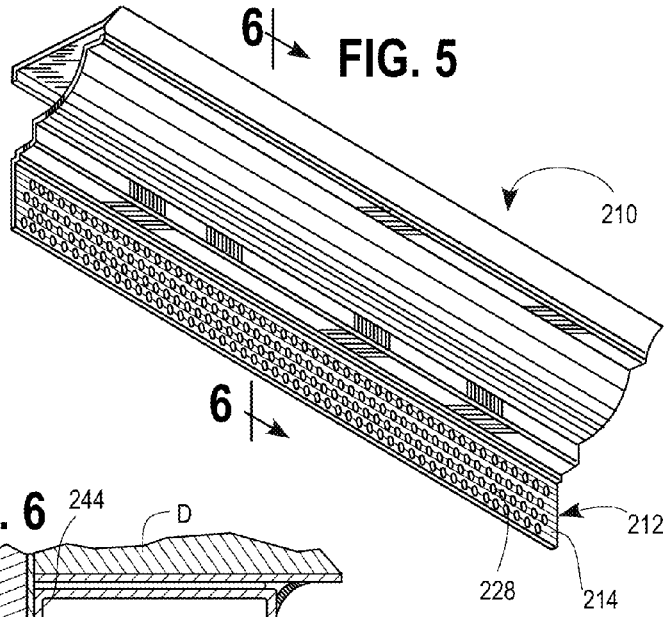
FIG. 5 is a perspective view of a section of crown molding having the present corner element.
Figure 6:
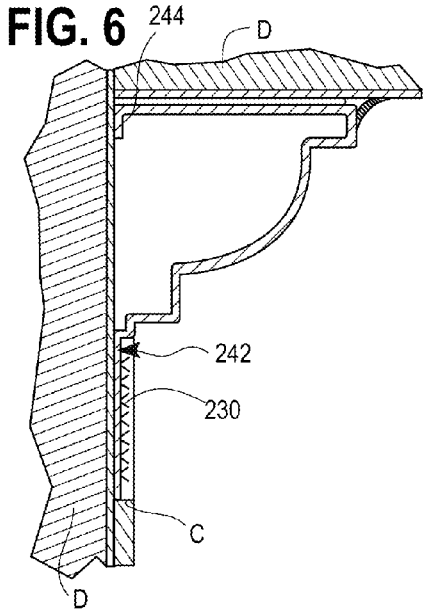
FIG. 6 is cross-sectional view of the crown molding taken along line 6-6 in FIG. 5.

The trimming element 10, 110 can be formed as a wide variety of elements, for example, the traditionally recognized outside corner element 10, 110 shown in FIGS. 1-4. It will be appreciated that the trimming element can be formed as a crown molding 210, such as that illustrated in FIG. 5. In this configuration, a flange 214 having the compound locking feature 212 can extend from an edge 242, e.g., bottom, of the molding 210 for securing the molding 210 to a wall D. A lip or flange 244 can be positioned at an opposite end or edge of the molding 210 that is interior to the molding 212 and is thus in a non-visible location. The flange 214 having the ribs 230 thereon is positioned at a visible end of the molding 210, and provides a surface that permits a smooth transition of joint compound C (feathering) between the molding 210 and the wall D.

Figure 7:
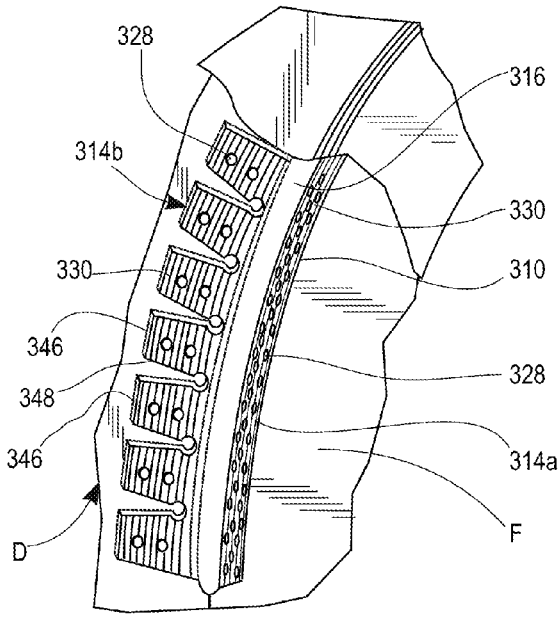
FIG. 7 is a section of archway molding having the present compound locking feature.

Another embodiment of the trimming element 310 is illustrated in FIG. 7 which shows an archway element that is suitable for archways around doors, windows and other arched architectural feature. The archway element 310 has a flat flange 314*a* (that flange that lies on a flat surface F) and the curved flange portion 314*b* (which is that portion that curves to form the arch). The curved flange portion 314*b* can be formed as a series of tabs 346 formed by slits 348 in the flange 314*b* that extend toward, but not into the corner (or nose) portion 316 of the element 310. This permits readily bending the element 310.

As can be seen in FIG. 7, the present compound locking feature or ribs 330 can be formed in the flat flange portion 314*a* and in the curved flange portion 314*b*, on the exterior flange 326 surfaces and although not shown, on the interior flange surfaces.

Figure 8:
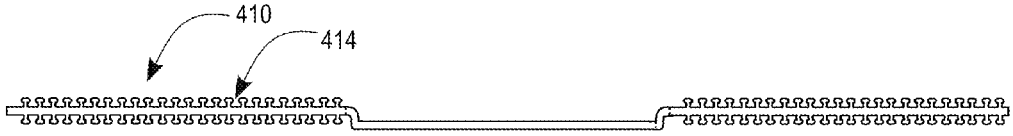
FIGS. 8, 8A through 12, 12A are sectional and enlarged partial views of alternate embodiments of the trimming element with compound locking feature.
Figure 8A:
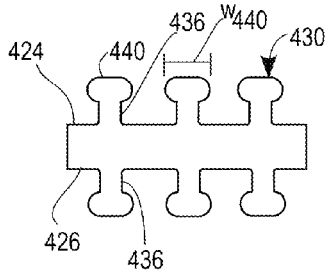

Other configurations of ribs and rib patterns are illustrated in FIGS. 8-12. FIGS. 8 and 8A illustrate an embodiment 410 of the element in which the ribs 430 extend generally normal to the surface 424, 426 of the flange 414, but include an enlarged head portion 440 that creates a void space 436 under the head 440, between the head 440 and the surface 424, 426. That is, the enlarged head 440 increases the region or space between the surface 424, 426 and the head 440 in which compound accumulates and sets around the rib 430. The heads 440 are flattened to further increase their width $w_{440}$, and thus increase the size or width of the void space 436.

Figure 9:
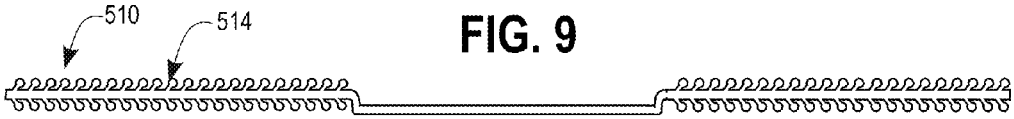
Figure 9A:
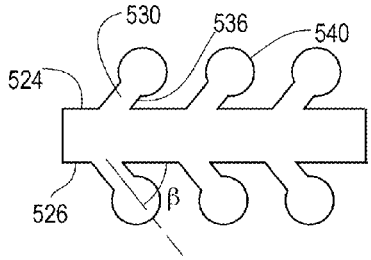

FIGS. 9 and 9A illustrate an embodiment 510 in which the ribs 530 extend straight, e.g., linearly, but at an angle β to the surface 524, 526. The ribs 530 are formed generally parallel to one another. Again the ribs 530 are formed with a head portion 540 to better establish the void space 536. In this configuration, the heads 540 are rounded.

Figure 10:
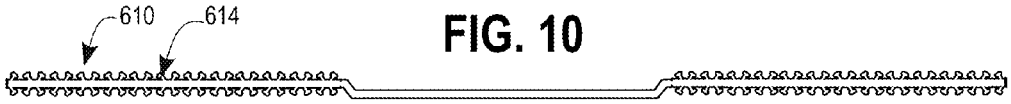
Figure 10A:
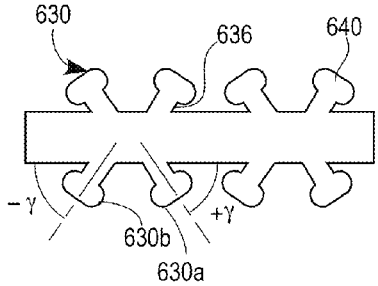

FIGS. 10 and 10A illustrate an embodiment 610 in which the ribs 630 extend straight (again, linearly), but at opposing angles γ to the surface 624, 626. The ribs 630*a* at a positive angle γ are formed generally parallel to one another and the ribs 630*b* at a negative angle γ are formed parallel to one another. Here, the ribs 630 are formed with a flattened head portion 640.

Figure 11:
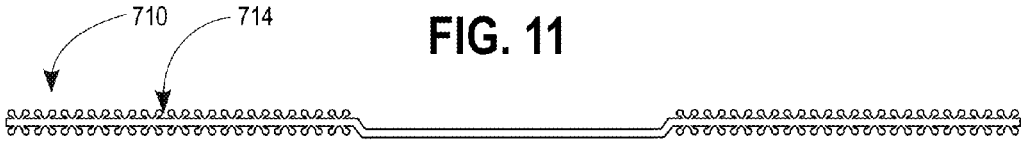
Figure 11A:
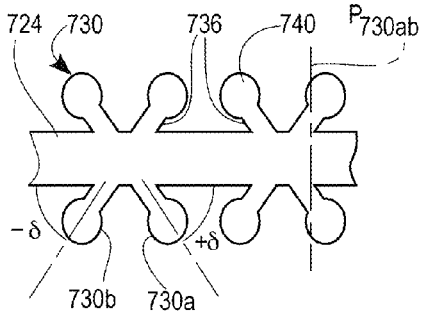

FIGS. 11 and 11A illustrate an embodiment 710 in which the ribs 730 extend straight (again, linearly), but at opposing angles δ to the surface 724, 726. The ribs 730*a* at a positive angle δ are formed generally parallel to one another and the ribs 730*b* at a negative angle δ are formed parallel to one another. Here, the ribs 730 are formed with a rounded head portion 740.

Figure 12:
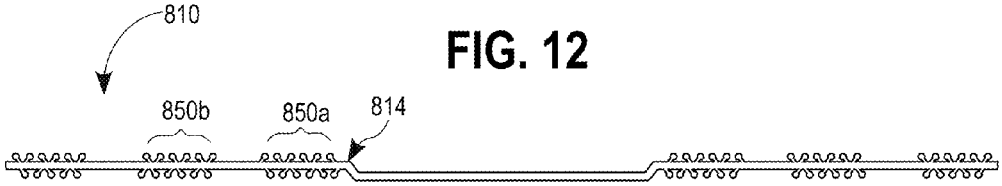
Figure 12A:
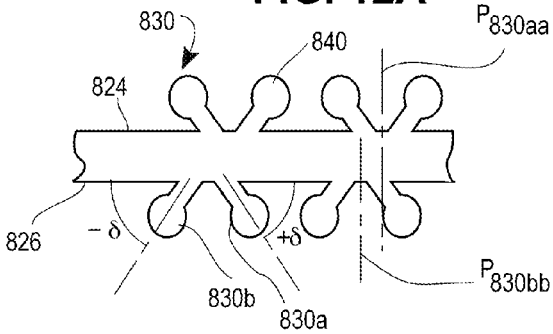

FIGS. 12 and 12A illustrate an embodiment 810 similar to FIGS. 11 and 11A in which the ribs 830 extend straight (again, linearly), but at opposing angles δ to the surface 824, 826. The ribs 830*a* at a positive angle δ are formed generally parallel to one another and the ribs 830*b* at a negative angle δ are formed parallel to one another. Here, too, the ribs 830 are formed with a rounded head portion 840.

In this embodiment, the ribs 830 extend from the surface 824 of the flange 814 at offset transverse plane locations (see, e.g., $P_{830aa}$ and $P_{830bb}$), compared, for example, to the ribs 730 illustrated in FIG. 11A, in which the ribs 730 extend from the same transverse plane $P_{730ab}$. That is, in this embodiment 810, the ribs 830 are staggered from one another. In addition, as is seen in FIG. 12, the ribs 830 can be formed in groups or sets 850*a*, 850*b* along the width of the flange 814, rather than in a continuous arrangement along the width.

It will be appreciated that numerous other shapes and elements and configurations and orientations of trimming elements, as well as the present compound locking feature can be used to affix or apply trimming elements to drywall, and that such other shapes and elements and configurations and orientations are within the scope and spirit of the present invention.

It will also be appreciated that although the trimming element is discussed as covering or trimming a corner or the like where two separate sections of drywall meet, it will be appreciated that the present trimming element with compound licking feature can be used on single drywall panel to, for example, provide an architectural detail such as a chair rail. It will be understood that such a trimming element can be affixed to a drywall panel, as a decorative feature and not intended to cove a corner. In such an application, the trimming element can include two flanges, but can also be configured having a single flange. Again, it will be understood that the trimming element spans, extends over or bridges two sections of drywall only insofar as there is drywall on either side of the element. This is not intended to limit the use or application of the trimming element, and the scope of the present invention, as to installations in which two separate drywall sections are bridged.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A flexible drywall trimming element for bridging two sections of drywall and configured for securing to the drywall by joint compound, comprising: first and second opposing flanges connected by a central region, each of the flanges having an interior surface and an exterior surface, the interior surfaces adapted to be positioned on or adjacent to a respective one of the drywall sections, and the exterior surfaces adapted for orienting away from the drywall sections, the interior and exterior surfaces each defining respective surface planes, the interior surface of each flange having a plurality of upstanding longitudinally oriented ribs extending outwardly from the surface, each of the ribs extending away from their respective interior surfaces to define a void space between the surface adjacent to the ribs and an end of the ribs, such that a line extending outwardly from and normal to the surface of the flange adjacent to the ribs traverses through the void space and then subsequently contacts the ribs, each of the ribs formed at an angle relative to their respective surfaces about equal to the other ribs, and at an angle less than 90 degrees, wherein when joint compound is disposed between the interior surface of the flanges and the drywall, the joint compound fills the void space and hardens to secure the drywall trimming element to the wall, and wherein the central region is devoid of ribs.

2. The drywall trimming element in accordance with claim 1 wherein the ribs have an enlarged head formed at an end thereof.

3. The drywall trimming element in accordance with claim 2 wherein the head has a generally round cross-sectional profile.

4. The drywall trimming element in accordance with claim 1 wherein the trimming element is in the form of a corner element having a central curved or curvable portion between the flanges.

5. The drywall trimming element in accordance with claim 4 wherein the flanges are offset rearwardly from the central portion.

6. The drywall trimming element in accordance with claim 1 wherein one or both of the flanges have openings therein.

7. A flexible drywall trimming element for bridging two sections of drywall, comprising: first and second flanges spanning a curved center portion, at least one of the flanges having a surface for facing relation to the drywall section and adapted to be secured to the section of drywall by application of a joint compound between the at least one flange and the section of drywall, the surface in facing relation to the drywall section having a plurality of compound locking members formed longitudinally along the surface extending from the flange in a direction transverse and non-normal to a plane of the flange, each of the compound locking members formed at an angle relative to the surface about equal to the other locking members, and at an angle greater than or less than 90 degrees, wherein when joint compound is disposed between the surface and the drywall, the joint compound fills the a space void between the locking member and the surface and hardens to secure the drywall trimming element to the wall, and wherein the central region is devoid of ribs.

8. The drywall trimming element in accordance with claim 7 wherein one or both of the flanges have openings therein.

9. The drywall trimming element in accordance with claim 7 wherein the molding is in the form of a corner molding.

10. The drywall trimming element in accordance with claim 9 wherein the molding is an outside corner molding.

11. The drywall trimming element in accordance with claim 7 wherein the ribs have an enlarged head formed at an end thereof.

12. A flexible drywall trimming element for application to drywall, configured for securing to the drywall by joint compound, comprising: a pair of flanges, each having an interior surface adapted to be positioned on or adjacent to the drywall, the flanges connected by a central region, the interior surface of each flange defining a surface plane, the interior surfaces having a plurality of upstanding longitudinally oriented ribs extending outwardly from their respective surfaces, the ribs extending away from the surfaces to define a void space between the respective surfaces adjacent to the ribs and an end of the ribs, such that a line extending outwardly from and normal to the respective surfaces of the flange adjacent to the ribs traverses through the void space and then subsequently contacts the ribs, each of the ribs formed at an angle relative to the respective surfaces about equal to the other ribs, wherein when joint compound is disposed between the interior surface of the mounted flange and the drywall, the joint compound fills the void space and hardens to secure the drywall trimming element to the wall, and wherein an exterior surface of the flange is formed without ribs, and wherein the central region is formed without ribs.

13. The drywall trimming element in accordance with claim 12 wherein the ribs extend away from the flange at an angle other than 90 degrees to the surface of the flange.

14. The drywall trimming element in accordance with claim 12 wherein the ribs have an enlarged head formed at an end thereof.

* * * * *